US005336419A

United States Patent [19]

Coffindaffer et al.

[11] Patent Number: 5,336,419

[45] Date of Patent: * Aug. 9, 1994

[54] SILICONE GEL FOR EASE OF IRONING AND BETTER LOOKING GARMENTS AFTER IRONING

[75] Inventors: Timothy W. Coffindaffer, Loveland; Robert G. Bartolo, Cincinnati, both of Ohio; Kathleen A. Belfiore, Beaver Falls, Pa.

[73] Assignee: The Procter & Gamble Company, Cincinnati, Ohio

[ * ] Notice: The portion of the term of this patent subsequent to Jan. 24, 2006 has been disclaimed.

[21] Appl. No.: 695,357

[22] Filed: May 8, 1991

Related U.S. Application Data

[63] Continuation-in-part of Ser. No. 534,109, Jun. 6, 1990, Pat. No. 5,064,543, and a continuation-in-part of Ser. No. 534,110, Jun. 6, 1990, Pat. No. 5,062,971.

[51] Int. Cl.[5] ..... D06M 11/00; C11D 3/00

[52] U.S. Cl. ..... 252/8.6; 252/8.8; 252/8.9; 252/174.15; 528/28; 528/38; 556/424; 556/425

[58] Field of Search ..... 252/8.6, 8.8, 174.15; 528/28, 38; 556/424, 425

[56] References Cited

U.S. PATENT DOCUMENTS

| | | | |
|---|---|---|---|
| 4,248,590 | 2/1981 | Koerner et al. | 252/8.6 |
| 4,283,191 | 8/1981 | Koerner et al. | 252/8.8 |
| 4,419,391 | 12/1983 | Tanaka et al. | 427/387 |
| 4,541,936 | 9/1985 | Ona et al. | 252/8.6 |
| 4,600,436 | 7/1986 | Traver et al. | 106/3 |
| 4,800,026 | 1/1989 | Coffindaffer | 252/8.8 |
| 4,911,852 | 3/1990 | Coffindaffer et al. | 252/8.8 |
| 4,911,853 | 3/1990 | Coffindaffer et al. | 252/174.15 |
| 4,923,623 | 5/1990 | Coffindaffer | 252/8.8 |
| 5,045,225 | 9/1991 | Aronson et al. | 252/174.15 |
| 5,049,377 | 9/1991 | Lamb et al. | 252/DIG. 13 |
| 5,057,240 | 10/1991 | Madore et al. | 252/174.15 |
| 5,062,971 | 11/1991 | Coffindaffer et al. | 252/174.15 |
| 5,064,543 | 11/1991 | Coffindaffer et al. | 252/174.15 |
| 5,064,544 | 11/1991 | Lin et al. | 252/174.15 |
| 5,071,573 | 12/1991 | Coffindaffer et al. | 252/8.8 |

FOREIGN PATENT DOCUMENTS

| | | | |
|---|---|---|---|
| 0058493 | 8/1982 | European Pat. Off. | 15/66 |
| 0354856 | 2/1990 | European Pat. Off. | 3/37 |
| WO87/03682 | 6/1987 | PCT Int'l Appl. . | |
| 1549180 | 7/1979 | United Kingdom | 83/04 |

OTHER PUBLICATIONS

"Silicones," by Hardman et al., Encyclopedia of Polymer Science and Engineering, vol. 15, 2nd Ed., pp. 206–207 and 271, John Wiley and Sons, Inc., 1989.

*Primary Examiner*—Paul Lieberman
*Assistant Examiner*—Michael Tierney
*Attorney, Agent, or Firm*—Betty J. Zea; Leonard Williamson

[57] ABSTRACT

This invention relates to fabric care compositions comprising a silicone gel for ease of ironing and improved appearance after ironing.

36 Claims, No Drawings

SILICONE GEL FOR EASE OF IRONING AND BETTER LOOKING GARMENTS AFTER IRONING

CROSS-REFERENCE TO RELATED APPLICATION

This is a continuation-in-part of commonly assigned U.S. patent applications Ser. No. 07/534,109 now U.S. Pat. No. 5,064,543 and Ser. No. 07/534,110, now U.S. Pat. No. 5,062,971 both filed Jun 6, 1990.

FIELD OF THE INVENTION

This invention relates to fabric care compositions and to a method for treating fabrics in order to improve various properties of the fabric, in particular, ease of ironing and improved appearance after ironing.

BACKGROUND OF THE INVENTION

In the modern world the vast majority of clothing is made from woven fabrics, and the art of weaving is many centuries old. Indeed the invention of weaving is generally attributed to the Ancient Egyptians. Yarns were produced from natural cotton, wool, or linen fibers, and garments made from fabrics woven from these yarns often creased badly in wear and, when washed, required considerable time and effort with a smoothing iron to restore them to a pristine appearance.

Within the last half century, textile manufacturers have implemented two major improvements in wash-and-wear garments: (1) the use of crosslinking resins on cotton containing garments, and (2) the use of synthetics and synthetic blends. Although these two implementations have made major strides in reducing the wrinkling of a garment, consumers are still dissatisfied with the results and feel a need to iron.

The term "ease of ironing and improved appearance after ironing" as used herein means that a fabric requires less effort to iron (i.e., improved glide of the iron and wrinkles are removed more easily) and has less wrinkles after a special cleaning operation followed by ironing than it would otherwise have after an ordinary cleaning operation and ironing.

It is, therefore, an object of the present invention to provide compositions which provide superior ease of ironing/appearance after ironing benefits to treated garments. This and other objects are obtained herein, and will be seen from the following disclosure.

SUMMARY OF THE INVENTION

This invention relates to fabric care compositions comprising a silicone gel agent for use in a fabric cleaning operation whereby an effective amount of said silicone gel is deposited on said fabric for ease of ironing and improved appearance after ironing.

DETAILED DESCRIPTION OF THE INVENTION

This invention relates to silicone gel compositions for fabric ease of ironing and improved appearance after ironing. In another respect this invention relates to methods of using such silicone gels compositions in the care of fabrics for improved ease of ironing and improved appearance after ironing. Preferred compositions are aqueous liquids which can also include a fabric softener and/or a surfactant or a starch. Such compositions are usually added to either the wash or rinse water of a laundering operation. These preferred compositions are aqueous based, water-dispersible additives which contain from about 0.1% to about 80%, more preferably from about 0.1% to about 50% of the silicone gels. The additives are diluted in the wash or rinse.

Surprisingly, the silicone gels plus a suitable carrier to deposit an effective amount of the silicone gel on fabric are excellent for ease of ironing and improved appearance after ironing. Accordingly, several fabric care compositions containing silicone gels are herein disclosed. Several methods of using silicone gels for ease of ironing and improved appearance after ironing fabric care are also disclosed.

The silicone gel compositions of this invention are used with a suitable carrier. The term "carrier" as used herein means any suitable vehicle (liquid, solid or mechanical) that is used to deliver the silicone gel and deposit it on the fabric. E.g., the silicone gel can be incorporated into an aqueous based softener or detergent composition, or an aqueous emulsion. It can be used in a bottled liquid spray. The preferred embodiments comprise: a liquid rinse water composition comprising the silicone gel plus fabric softener.

In a preferred execution, about 0.1% to about 10% by weight of a silicone gel is mixed into a suitable commercially available laundry liquid fabric softener composition. The result is a fabric care composition that provides an improved ease of ironing and improved appearance after ironing benefit to the treated fabric.

In another execution, a similar amount is mixed into a suitable commercially available liquid detergent and/or softener composition (anionic/nonionic surfactant based detergent, e.g., Liquid TIDE®, or a nonionic surfactant based detergent, e.g., BOLD$_3$ Liquid®). Care must be taken to use silicone gel emulsifiers compatible to the detergent surfactants to avoid deemulsification of the silicone gel. The new liquid detergent/silicone gel product provides an unexpected ease of ironing and improved appearance after ironing benefit. In yet another execution, the silicone gel can be sprayed directly on moistened fabric. In the wash or rinse liquid, the level of silicone gel should be about 1–300 ppm, preferably 5–150 ppm. In a direct spray on application, the silicone gel level could be higher, e.g., 1,000 ppm to 200,000 ppm.

In another execution, this invention comprises a liquid starch composition comprising the silicone gel plus starch and a suitable carrier. In a preferred execution, about 0.1% to about 10% by weight of an emulsified silicone gel is mixed into a suitable commercially available pump spray starch composition. The result is a spray starch composition that provides an improved ease of ironing and improved appearance after ironing to fabric sprayed therewith. Suitable commercially available spray starch compositions are based on water and a suitable emulsifier. Care must be taken to use silicone gel emulsifiers which are compatible with the starch and the silicone gel to avoid deemulsification. A second execution includes a laundry rinse wherein the level of silicone gel is present in the rinse water at about 1–300 ppm, preferably about 5–150 ppm.

While not wishing to be bound by theory, these silicone gels once deposited on the fabric are believed to spread and form a three-dimensional film on the fabric during the laundering process which aids in ease of ironing, wrinkle removal during ironing, and better appearance of the fabric after ironing.

Preferably, care should be taken to insure that the compositions of the present invention are essentially free of heavy waxes, abrasives, fiberglass, and other fabric incompatibles.

Silicone Gels

Silicone gels are somewhat of a cross between silicone fluids and silicone resins. Silicone fluids are by definition flowable silicone polymers of varying viscosities that can be branched or linear. Where typically, silicone resins are highly crosslinked siloxane solid systems with the crosslinking components introduced as tri-functional (T) (e.g., $RSiO_{1.5}$) or tetra-functional units (Q) (e.g., $SiO_2$). As one increases the tri- or tetra- (quat-) functional units without increasing the mono-functional or terminal component (M) (e.g., $R_3SiO_{0.5}$), the resin becomes more brittle.

Most importantly for this invention, as one increases the di-functional units (D) (e.g., $R_2SiO$), the resin becomes softer and eventually is considered a silicone gel. In addition to the influence of mono-, tri-, tetra-, and di-functional units on the silicone resins and gels, their characteristics can also be influenced by changing the organic group. The terms Q, tetra-, and quat- are synonymous. While not being too limiting, typical silicone resins and gels use methyl, phenyl, vinyl, and mixtures thereof as the organic groups. Other possible groups include amines (primary, secondary, tertiary, quaternary, cyclic, diamines and triamines), epoxides, esters, ethers, halo functional organics, carboxy, etc., including hydrogen.

The silicone gel important for this invention is very soft as compared to resins and has a lower level of crosslinking (i.e., a lower level of tri- (T) and/or tetra- (Q) functional units) as compared to silicone resins. The silicone gel of this invention also has a higher level of crosslinking as compared to a silicone fluid or a viscous silicone gum. More specifically, a preferred silicone gel has from about 3% to about 30% T and/or Q functional units, from about 70% to about 97% D functional units, and from about 0.1% to about 10% M functional units; preferably, the silicone gel has from about 5% to about 20% T and/or Q functional units, from about 80% to about 95% D functional units, and from about 0.3% to about 8% M functional units. More preferably, the silicone gel has from about 5% to about 15% T and/or Q functional units, from about 85% to about 95% D functional units, and from about 0.5% to about 5% M functional units wherein M is curable and is represented by

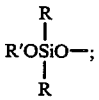

wherein R and R' are preferably independently alkyl or H or some other group selected from, but not limited to, amines (primary, secondary, tertiary, quaternary, cyclic, diamines and triamines), epoxides, esters, ethers, halo functional organics, carboxy, etc., including hydrogen. The polymeric silicone gel should have a molecular weight greater than about 20,000; greater than about 50,000; even greater than about 100,000; The molecular weight of the silicone gel can be greater than about 500,000±400,000, and even greater than about 1,000,000. Theoretically, their molecular weights can go as high as $10^{20}$. The polymeric silicone of the present invention preferably is less than $10^{15}$, and even more preferably less than $10^{10}$. The important factor is that the polymeric silicone is in the form of a gel. At higher levels of the T and/or Q functional units, the molecular weight of the gel can be lower.

In addition, the silicone gel must be in a form in which it can be delivered to the laundered fabric, preferably via an aqueous vehicle; thus an emulsified form is very desirable. While not limiting the emulsification of a preformed gel, the generation of the silicone gel itself in an emulsion is a preferred method of making the preferred embodiment of this invention.

This can be accomplished by many different methods. Two general methods are: (1) emulsion polymerization (see U.S. Pat. No. 4,600,436, Traver/Thimineur/Zotto, issued Jul. 15, 1986, for Durable Silicone Emulsion Polish, incorporated herein by reference, particularly col. 6, 11. 35–47); and (2) emulsification of polymers followed by curing in the emulsion (see "Silicones," by Hardman et al., *Encyclopedia of Polymer Science and Engineering,* Vol. 15, Second Edition, pages 204–308, John Wiley and Sons, Inc., 1989, also incorporated herein by reference). There are four methods of curing set out in Harding et al.: (1) condensation; (2) peroxide; (3) platinum-catalyzed hydrosilation; and (4) Uv. These curing methods are known in the art, however, one must take care in picking the starting materials and reaction conditions to insure obtaining the desired "gel."

One specific method of the generation of a gel is to first emulsify a curable branched silicone polymer, then cure the polymer to a gel within the emulsion droplet before delivering to the fabric. For example: an emulsified branched curable amine functional silicone (experimental emulsion supplied by General Electric Co., No. 124-7701, which is a 20% emulsion of a GE commercially available curable amine functional silicone, sold under the trade name SF 1706) at a pH of 9 to 10 heated at 50° C. in a glass container for 5 to 10 days yields an emulsified silicone gel.

The silicone gel is made from a branched curable amine functional silicone having the following structure:

$$((RO)R'_2SiO_{1/2})_X(R'_2SiO_{2/2})_Y(R''SiO_{3/2})_Z;$$

wherein X is equal to Z+2; and Y is at least 3; and wherein Z is at least 1; wherein R', R'' is a $C_{1-20}$ alkyl or an amine group selected from cyclic amines, polyamines and alkylamines having from about 2 to about 7 carbon atoms in their alkyl chain, and wherein at least R' or R'' is an amine group; and wherein the curable amine functional silicone is cured in an emulsified form by heat and/or the addition of base to form an emulsified silicone gel.

A preferred silicone is when: R is a hydrogen or a $C_{1-3}$ alkyl; R' is $C_{1-3}$ alkyl; and R'' is an alkylamine group having from about 2 to about 7 carbon atoms in its alkyl chain; and wherein the curable amine functional silicone is cured in an emulsified form by heat and/or the addition of base to form an emulsified silicone gel.

The more preferred silicone is when: R is methyl; R' is methyl; R'' is $(CH_2)_3NH(CH_2)_2NH_2$; X is about 4; Y is about 27 and Z is about 2; and wherein said silicone has a molecular weight in the range of from about 1,000 to about 2,800 and a viscosity of about 5–40 centistokes at 25° C.; and wherein the curable amine functional silicone is cured in an emulsified form by heat and/or the addition of base to form an emulsified silicone gel.

The physical properties of this system are vastly different than those of the starting polymer. The advantages of using the curable amine functional silicones for wrinkle reduction have been previously disclosed in U.S. Pat. Nos.: 4,800,026, Coffindaffer/-Wong, issued Jan. 24, 1989; 4,911,852, Coffindaffer/Trinh issued Mar. 27, 1990; and 4,923,623, Coffindaffer, issued May 8, 1990, all of said patents incorporated herein by reference, in which a polymer is delivered to the fabric and then permitted to cure by reacting with other silicones. Much to our surprise, if one cures the polymer to form a gel in the emulsion and then delivers the gel via a liquid vehicle, ease of ironing and improved appearance after ironing benefits can be achieved that are consumer noticeable.

The reaction time of producing the gel disclosed above can be decreased by increasing ,the pH of the emulsion. For example, at pH of 13, the gel of emulsified SF 1706 can be formed in 6 to 30 hours depending on the desired degree of cure before addition to product. An increase in temperature to ambient up to about 75° C.±15° C. can also increase the rate of the curing reaction while a decrease in pH slows the curing reaction rate, e.g., at a pH of about 2.5, almost no curing takes place after one month at 23° C. Care should, be taken to keep the temperature low enough so as to keep the emulsion intact.

In this reaction, the amine and base in the system act as the catalysts for the condensation curing reaction. The effectiveness of alkali metal hydroxides as catalysts increases in the order $Li^+ < Na^+ < K^+ < Rb^+ < Cs^+$. Many other methods which do not require the use of amines or bases for curing silicone polymers are well-known in the art, some of which are disclosed in the *Encyclopedia of Polymer Science and Engineering,* Vol.15, Second Edition, pages 204–308, John Wiley and Sons, Inc., 1989, and thus incorporated herein by reference.

One method of characterizing silicone gels is $^{29}Si$; NMR. Even in the emulsified form (with a relaxation aid such as $Cr(acac)_3$), M, D, T and Q are easily identified in the ranges specified above.

The fabric care composition of this invention comprises a suitable silicone gel, and, preferably, another fabric care material, e.g., one selected from organic solvents, water, surfactants, fabric softeners, soil release agents, builders, brighteners, perfumes, dyes, and mixtures thereof.

One embodiment of the present invention is a liquid fabric softener composition comprising an effective amount of a silicone gel and a fabric softener selected from the softeners disclosed in U.S. Pat. No. 4,661,269, Trinh et al., issued Apr. 28, 1987, incorporated herein by reference. U.S. Pat. No. 3,904,533, Neiditch et al., issued Sep. 9, 1975, incorporated herein by reference, teaches a number of other fabric conditioning formulations suitable for the present invention.

Liquid Detergent

Another embodiment of the present invention is a liquid detergent composition comprising an effective amount of silicone gel and a surfactant, e.g., one selected from those disclosed in U.S. Pat. Nos.: 4,318,818, Letton et al., issued Mar. 9, 1982, and 4,911,852, Coffindaffer/Trinh, issued Mar. 27, 1990, both incorporated herein by reference. A suitable surfactant can be selected from anionic, nonionic, amphoteric, zwitterionic and cationic surfactants, and mixtures thereof. In preferred executions, the addition of from about 0.1% to about 33%, preferably from about 0.5% to about 20%, and, more preferably from about 1.0% to about 10% of the silicone gel by weight of the total liquid detergent composition can result in a product that provides outstanding ease of ironing and improved appearance after ironing benefits when fabric is washed therein in the usual manner.

Some Preferred Embodiments

The preferred composition of this invention is an aqueous dispersion comprising: a silicone gel wherein the silicone gel to fabric softener has a weight ratio of from about 17:1 to about 350, preferably from about 10:1 to about 1:100. Some more preferred weight ratios of silicone gel to fabric softener are from 1:1 to 1:10 and from 1:5 to 1:10. These compositions are added to the rinse water for ease of ironing and improved appearance after ironing and fabric softening benefits.

Suitable fabric softener(s) are selected from the group consisting of:

i. quaternary ammonium compound;
ii. fatty amine fabric softening compound;
iii. fatty amide compound;
iv. fatty acids;
v. fatty alcohols; and
vi. mixtures thereof.

In certain liquid rinse-added compositions of this invention the amount of fabric softener can range from about 2% to about 35%, preferably from about 4% to about 27%, by weight of the total composition. The lower limits are amounts needed to contribute effective fabric softening performance when added to laundry rinse baths in the manner which is customary in home laundry practice. The higher limits are suitable for more concentrated liquid products which require smaller volume usage.

The preferred levels of silicone gel in such composition can range from about 0.05% to about 40%; from about 0.1% to about 20%; and from about 0.5% to about 10% by weight of the concentrate.

Suitable fabric softener compounds include quaternary ammonium salts, as well as nonquaternary amines and amine salts.

Compositions containing cationic nitrogenous compounds in the form of quaternary ammonium salts and substituted imidazolinium salts having two long chain acyclic aliphatic hydrocarbon groups provide fabric softening benefits when used in laundry rinse operations. (See, for example, U.S. Pat. Nos. 3,644,203, Lamberti et al., issued Feb. 22, 1972; and 4,426,299, Verbruggen, issued Jan. 17, 1984; also "Cationic Surface Active Agents as Fabric Softeners," R. R. Egan, Journal of the American Oil Chemists' Society, January 1978, pages 118–121; and "How to Choose Cationics for Fabric Softeners," J. A. Ackerman, Journal of the American Oil Chemists' Society, June 1983, pp. 1166–1169).

Other suitable fabric softening compounds are the nonquaternary amides and the nonquaternary amines. A commonly cited material is the reaction product of higher fatty acids with hydroxy alkyl alkylene diamines. An example of these materials is the reaction product of higher fatty acids and hydroxyethylethylenediamine (See "Condensation Products from beta-hydroxyethylethylenediamine and Fatty Acids or Their Alkyl Esters and Their Application as Textile Softeners in Washing Agents," H. W. Eckert Fette-Seifen-Anstrichmittel, September 1972, pages 527–533). These materials are usually cited generically along with other cationic quaternary ammonium salts and imidazolinium salts as softening actives in fabric softening compositions. (See U.S. Pat. Nos. 4,460,485, Rapisarda et al., issued Jul. 17, 1984; 4,421,792, Rudy et al., issued Dec. 20, 1983; 4,327,133, Rudy et al., issued Apr. 27, 1982).

A particularly preferred fabric softener is in the form of an aqueous dispersion comprising from about 3% to about 35% by weight of a mixture consisting of:

(a) from about 10% to about 92% of the reaction product of a higher fatty acid with a polyamine selected from the group consisting of hydroxyalkylalkylenediamines and dialkylenetriamines and mixtures thereof, and (b) from about 8% to about 90% of cationic nitrogenous salts having only one long chain acyclic aliphatic $C_{15}$-$C_{22}$ hydrocarbon group, and optionally (c) from 0% to about 80% of a cationic nitrogenous salt having two or more long chain acyclic aliphatic $C_{15}$-$C_{22}$ hydrocarbon groups or one said group and an arylalkyl group having from about 15 to about 22 carbon atoms in its alkyl chain.

For a detailed description of some preferred fabric softeners, see commonly assigned U.S. Pat. No. 4,661,269, Trinh/Wahl/Swartley/Hemingway, issued Apr. 28, 1987, incorporated herein by reference in its entirety.

The terms herein, e.g., softener compound, in general, denotes both singular and plural unless otherwise specified.

Starch

A preferred embodiment of the present invention is a liquid starch composition comprising an effective amount of silicone gel and up to about 99% liquid starch composition selected from conventional aqueous starch compositions. Such compositions contain from about 0.1% to about 35%, preferably from about 0.5% to about 20%, starch, a little surfactant, minors, and the balance water. Starch is employed to aid in ironing and sizing and to act as a carrier for the silicone gel component. Thus, any of the aqueous based starch compositions used in the fabric care art may be used herein. E.g., U.S. Pat. Nos. 4,780,499, Villarreal et al., issued Oct. 25, 1988; 3,644,241, Falivene, issued Feb., 1972; 3,833,393, Kandathil, issued Sep., 1974; and 4,495,226, Smith, issued Jan. 22, 1985; incorporated herein by reference in their entirety, disclose suitable starch and starch derivative compositions.

Preferred carriers are liquids selected from the group consisting of water and mixtures of the water and short chain $C_1$–$C_4$ monohydric alcohols. The water which is used can be distilled, deionized, or tap water. Mixtures of water and up to about 10%, preferably less than about 5%, of a short chain alcohol such as ethanol, propanol, isopropanol or butanol, and mixtures thereof, are also useful as the carrier liquid.

Some short chain alcohols are present in commercially available quaternary ammonium compound products. Such products can be used in the preparation of preferred aqueous compositions of the present invention. The short chain alcohols are normally present in such products at a level of from from about 1% to about 10% by weight of the aqueous compositions.

Other carriers are suitable solids, polyol waxes and wax-like materials commonly used in the detergent and dryer-added softener fields and spray containers.

Some Optional Ingredients and Preferred Embodiments

Compatible adjuvants can be added to the compositions herein for their known purposes. Such adjuvants include, but are not limited to, viscosity control agents, perfumes, emulsifiers, preservatives, antioxidants, bactericides, fungicides, colorants, dyes, fluorescent dyes, brighteners, opacifiers, freeze-thaw control agents and shrinkage control agents, and other agents to provide ease of ironing (e.g., starches, etc.). These adjuvants, if used, are added at their usual levels, generally each of up to about 5% by weight of the preferred liquid composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the liquid compositions herein, and later to obtain the desired viscosity. The amount of ionizable salts used depends on the amount of active ingredients used in such compositions and can be adjusted according to the desires of the formulator. Typical levels of salts used to control the composition viscosity are from about 20 to about 6,000 parts per million (ppm), preferably from about 20 to about 4,000 ppm by weight of the composition.

Typical levels of compatible bactericides used in the present compositions are from about 1 to about 1,500 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The compositions may contain noncurable silicone fluids to provide additional benefits such as improved fabric feel. The preferred adjunct silicones are polydimethylsiloxanes of viscosity of from about 100 centistokes (cs) to about 100,000 cs, preferably from about 200 cs to about 60,000 cs. These adjunct silicones can be used as is, or can be conveniently added to the softener compositions in a preemulsified form which is obtainable directly from suppliers. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

A preferred composition contains from about 1 ppm to about 1,000 ppm of bactericide and from about 0.2% to about 2% of perfume, from 0% to about 3% of polydimethylsiloxane, from 0% to about 0.4% of calcium chloride, from about 10 ppm to about 100 ppm of dye, and from 0% to about 10% of short chain alcohols, by weight of the total composition.

The pH of the preferred compositions of this invention is generally adjusted to be in the range of from about 2 to about 11, preferably from about 2 to about 8. Adjustment of pH is normally carried out by including a small quantity of free acid or free base in the formulation. Any acidic material can be used; its selection can be made by anyone skilled in the softener arts on the basis of cost, availability, safety, etc. Any suitable acid can be used to adjust pH. Preferred are hydrochloric, sulfuric, phosphoric and formic acid. Similarly, any suitable base, e.g., sodium hydroxide, can also be used to adjust pH. For the purposes of this invention, pH is measured by a glass electrode in full strength softening composition in comparison with a standard calomel reference electrode.

The compositions of the present invention can be prepared by a number of methods. Some convenient and satisfactory methods are disclosed in the following nonlimiting examples.

EXAMPLE I

Procedure A

A liquid fabric softener composition containing a silicone gel is prepared in the following manner. 4.33 parts di(hydrogenated tallow)dimethylammonium chloride (DTDMAC), 1.00 part methyl-1-tallow amidoethyl-2-tallowimidazolinium methylsulfate and 0.025 parts dye are weighed into a premix vessel.

After heating to 75° C. and mixing, the premix is added, with agitation, to a mix vessel (44° C.) containing 88.14 parts distilled water and 0.025 parts antioxidant solution. Then 0.45 parts of perfume is added to this "main" mix. The main mix is then cooled to 21° C., to which is added with stirring 5.0 parts emulsified silicone gel (20% silicone).

Procedure B

Same as Procedure A, except that the emulsified silicone gel is incorporated into the main mix prior to cooling of the mix to 21° C.

The ratios of polymeric silicone gel to total fabric softeners is about 1:5. The molecular weight of the polymeric silicone gel is at least about 100,000, and some gel particulates may have molecular weights estimated to be greater than 1,000,000. The functional units of this silicone gel are about 10% T and Q; 88% D and 2% M with an estimated ±15% relative for each level.

TABLE 1

| Ingredient | A and B Wt. % |
|---|---|
| DTDMAC[1] | 4.33 |
| Methyl-1-tallowamidoethyl-2-tallow imidazolinium methylsulfate | 1.00 |
| Alcohol (from actives) | 0.80 |
| Perfume | 0.45 |
| Dye solution | 0.02 |
| Emulsified Silicone Gel[2] | 5.00 |
| Antioxidant[3] | 0.025 |
| Distilled Water | 88.37 |

[1]Di(hydrogenated tallow)dimethyl ammonium chloride
[2]A specialty aqueous emulsion 124-7701 (defined hereinabove) is made by General Electric Company. It contains 20% SF 1706 (defined hereinabove) and about 5% of a mixture of octylphenoxypolyethoxyethanol and alkylphenylpoly(oxyethylene)-glycol emulsifiers. The emulsified silicone is then made into a gel by heating the emulsion in a glass container at 120° F. (50° C.) for 7 days.
[3]Tenox S-1 supplied by Eastman Kodak.

EXAMPLE II

A silicone gel and fabric softener composition is prepared using Procedure A. The ingredients are:2.00 parts Mazamide 6, 0.80 parts MTTMAC, 4.03 parts DTDMAC, 1.00 parts imidazolinium salt, 0.42 parts perfume, 1.28 parts alcohol (from actives), 10.00 parts 20% emulsified silicone gel, and the balance in distilled water. See Table 2 and Example I for a recap of the ingredients and method of preparation. The ratio of silicone gel to total fabric softener is about 1:7.

EXAMPLE III

A silicone gel and fabric softener composition is prepared using Procedure A. The ingredients are:17.50 parts Mazamide 6, 6.50 parts DTDMAC, 1.32 parts perfume, 2.07 parts alcohol (from actives), 12.00 parts 20% emulsified silicone gel, and the balance in distilled water. See Table 2 and Example I for a recap of the ingredients and method of preparation. The ratio of gel to total softener is about 1:10.

TABLE 2

| Ingredient | Example II Wt. % | Example III Wt. % |
|---|---|---|
| Mozamide 6[1] | 2.00 | 17.50 |
| MTTMAC[2] | 0.80 | — |
| DTDMAC[3] | 4.03 | 6.53 |
| Perfume | 0.42 | 1.32 |
| Polar Brilliant Blue Dye | 0.025 | 0.072 |
| Alcohol (from actives) | 1.28 | 2.07 |
| Emulsified Silicone Gel (20%) | 10.00 | 12.00 |
| Distilled Water | Balance | Balance |

[1]Reaction product of 2 moles of hydrogenated tallow fatty acid with 1 mole of N-2-hydroxyethylenediamine
[2]Mon(hydrogenated tallow)trimethyl ammonium chloride
[3]Di(hydrogenated tallow)dimethyl ammonium chloride

COMPARATIVE EXAMPLE IV

Product BM

An amine functional silicone gel (AFSG) and fabric softener composition is prepared using Procedure A. The ingredients are:3.75 parts DTDMAC, 3.40 parts imidazoline, 0.57 parts MTTMAC, 0.40 parts perfume, 0.025 parts dye, 0.77 parts alcohol (from actives), 0.4–0.9 parts HCl, 5.00 parts AFSG and the balance is distilled water.

Comparative Product D

A fabric softener composition is prepared as in Product BM, except no AFSG is added.

See Table 3, Example IV for a recap of ingredients for products BM & D.

Products BM & D were used as rinse-added fabric softeners to treat poly cotton (65%/35%) and 100% cotton fabrics. The fabrics were treated with five successive wash/rinse/dry treatments. The detergents used were TIDE ® and Liquid TIDE ®. Forty-eight sets of swatches saw only TIDE and twenty-five only Liquid TIDE. Keeping the Liquid TIDE and TIDE washed fabrics separate, panelists were asked to iron one of each fabric type for each treatment and choose which were the easiest to iron. After ironing, the fabrics were placed on a hanger and judged for appearance (least wrinkled). The "no preference" votes were divide in half and split evenly among the treatments. Results are summarized below.

| | % Choosing BM | | % Choosing D |
|---|---|---|---|
| | Ease of Ironing | | |
| Cotton | 58 | | 42 |
| Poly Cotton | 64 | S | 36 |
| | Appearance After Ironing | | |
| Cotton | 61 | S | 39 |
| Poly Cotton | 65 | S | 35 |

S = significant difference at greater than or equal to 90% confidence.

EXAMPLE V

About 25 grams of emulsified silicone gel (25 parts) (20% silicone gel) is added to 75 parts of a 2–3% starch composition (SPRAY 'N STARCH ® made by Texize, a division of Dow, Inc.) with stirring at ambient temperature. This mixture containing about 5% silicone gel is used as a pre-ironing spray-on for ease of ironing and improved appearance after ironing.

EXAMPLES VI AND VII

Two additional starch/silicone gel compositions are prepared as in Example V. About 5 parts and 50 parts of the 20% silicone gel emulsion are, respectively, mixed with the liquid SPRAY 'N STARCH compositions to provide, respectively, stable 1% and 10% silicone gel compositions.

The starch compositions are stable.

TABLE 3

| | Example IV | |
|---|---|---|
| Ingredient | Product BM Wt. % | Product D Wt. % |
| MTTMAC[1] | 0.57 | 0.57 |
| DTDMAC[2] | 3.75 | 3.75 |
| Imidazoline[3] | 3.40 | 3.40 |
| Perfume | 0.40 | 0.40 |
| Polar Brilliant Blue Dye | 0.025 | 0.025 |
| Alcohol (from actives) | 0.77 | 0.77 |
| Emulsified Silicone Gel (20%) | 5.00 | — |
| HCl (31.5%) | 0.4–0.9 | 0.4–0.9 |
| Distilled Water | Balance | Balance |

[1]Mono(hydrogenated tallow)trimethyl ammonium chloride
[2]Di(hydrogenated tallow)dimethyl ammonium chloride
[3]1-hydrogenated tallow amidoethyl-2-hydrogenated tallow imidazoline The incorporation of emulsified silicone gel into the exemplified fabric softener compositions improves the ease of ironing and the appearance of laundered fabrics (e.g., Product BM vs. Product D). The fabric care compositions of this invention work very well on laundered polyesters, cottons and cotton/polyester blends.

What is claimed is:

1. A liquid fabric care composition comprising:

(1) a substantially cured emulsified amine functional polymeric silicone gel;

wherein said polymeric silicone is curable and has

T (tri-functional units)=R'' $SiO_{3/2}$;

Q (quat-functional units)=$SiO_{4/2}$;

D (di-functional units)=$R'_2$ $SiO_{2/2}$; and

M (mono-functional units)=(RO)$R'_2$ $SiO_{1/2}$;

wherein R', R'' is a $C_{1-20}$ alkyl or an amine group selected from cyclic amines, polyamines and alkylamines having from about 2 to about 7 carbon atoms in their alkyl chain and wherein at least one of R' or R'' is an amine group; wherein R is a hydrogen or a $C_{1-3}$ alkyl; wherein said polymeric silicone contains from about 3% to about 30% of said T or said Q functional units, or mixtures thereof; from about 70% to about 97% of said D functional units; and from 0.1% M functional units to about 10%; and (2) an effective amount of another fabric care compound selected from starches, surfactants, fabric softener and mixtures thereof; and (3) a suitable carrier to deposit an effective amount of said silicone gel on said fabric;

wherein said fabric softener is selected from the group consisting of:

i. quaternary ammonium compounds;
ii. fatty amine fabric softening compounds;
iii. fatty amide compounds;
iv. fatty acids;
v. fatty alcohols; and
vi. mixtures thereof;

wherein said silicone gel is substantially cured via crosslinking prior to deposition on treated fabric; and wherein the said polymeric silicone has a molecular weight of from about 150,000 to about $10^{15}$.

2. The fabric care composition of claim 1 wherein the said polymeric silicone gel is made by emulsion polymerization.

3. The fabric care composition of claim 1 wherein the said silicone gel is made by emulsifying said curable silicone polymer and curing via crosslinking said curable silicone polymer in the emulsion.

4. The fabric care composition of claim 3 wherein said curing is accelerated in said silicone polymer with a curing catalyst.

5. The fabric care composition of claim 3 wherein said curing silicone gel is accelerated with heat.

6. The fabric care composition of claim 5 wherein said curable silicone polymer is a branched curable amine functional silicone polymer and said curing is accelerated with a curing catalyst.

7. The fabric care composition of claim 6 wherein said curing catalyst is a base and said heat is ambient temperature up to about 75° C.±15° C.

8. The fabric care composition of claim 1 wherein said composition is a concentrate which contains from about 0.05% to about 40% by weight of said silicone gel and wherein said concentrate can be diluted when used.

9. The fabric care composition of claim 8 wherein said concentrate is an aqueous liquid containing from about 0.1% to about 20% of said silicone gel and said carrier is primarily water.

10. The fabric care composition of claim 8 wherein said concentrate contains from about 0.5% to about 10% of said silicone gel.

11. The fabric care composition of claim 1 wherein said fabric softener is present at a level of from about 3% to about 35% by weight of the total composition; and wherein the silicone gel and the fabric softener have a weight ratio of from about 17:1 to about 1:350.

12. The fabric care composition of claim 11 wherein said weight ratio of silicone gel and fabric softener is from about 10:1 to about 1:100.

13. The fabric care composition of claim 11 wherein said weight ratio of silicone gel and fabric softener is from about 1:1 to about 1:10.

14. The fabric carecomposition of claim 11 wherein the weight ratio of silicone gel and fabric softener is from about 1:5 to about 1:10.

15. The fabric care composition of claim 2 wherein said polymeric silicone gel has a molecular weight greater than about 500,000.

16. The fabric care composition of claim 2 wherein said polymeric silicone gel has from about 5% to about 20% T or Q functional units or mixtures thereof, from about 80% to about 95% D functional units, and from 0.1% to about 8% M functional units; and a molecular weight greater than about 150,000.

17. The fabric care composition of claim 16 wherein said polymeric silicone has from about 5% to about 15% of said tri- or quat-functional units or mixtures thereof, from about 85% to about 95% of said difunctional units, and from about 2% to about 5% of said monofunctional units; and a molecular weight of from about 150,000 to about 1,000,000.

18. The fabric care composition of claim 1 wherein said silicone gel is made from a branched curable amine functional silicone having the following structure:

$$((RO)R'_2SiO_{1/2})_X(R'_2SiO_{2/2})_Y(R''SiO_{3/2})_Z;$$

wherein

X is equal to Z+2; and

Y is at least 3; and wherein

Z is at least one;

wherein at least R′ or R″ is an amine group, and wherein the curable amine functional silicone is cured in an emulsified form to an emulsified silicone gel.

19. The fabric care composition of claim 18 wherein

R′ is $C_{1-3}$ alkyl; and

R″ is an alkylamine group having from about 2 to about 7 carbon atoms in its alkyl chain; and wherein the curable amine functional silicone is cured in an emulsified form by heat or the addition of base to form an emulsified silicone gel.

20. The fabric care composition of claim 19 wherein said R is methyl; R′ is methyl and R″ is $(CH_2)_3NH(CH_2)_2NH_2$; and X is about 3.5; Y is about 27 and Z is about 2; and wherein said silicone has a molecular weight, before curing, in the range of from about 1,000 to about 2,800 and a viscosity of about 5–40 centistokes at 25° C.; and wherein the curable amine functional silicone is cured in an emulsified form by heat or the addition of base to form an emulsified silicone gel.

21. The fabric care composition of claim 1 wherein said fabric softener comprises amine compound.

22. The fabric care composition of claim 1 wherein said fabric softener comprises quaternary ammonium compound.

23. The fabric care composition of claim 1 wherein said fabric softener is selected from the group consisting of said amide, amine and quaternary ammonium compounds, and mixtures thereof.

24. The fabric care composition of claim 1 wherein said another fabric care compound is a starch; said starch being present at a level of from about 0.5% to about 20% by weight of said composition.

25. The composition of claim 1 wherein said composition is used to improve ease of ironing and appearance of fabrics after ironing by contacting said fabrics with an effective amount of water and said composition and ironing said fabrics to cure said amine functional silicone on said fabrics.

26. The composition of claim 25 wherein said carrier is an aqueous laundry solution; and wherein said silicone gel is present in said solution at a level of from about 1 ppm to about 300 ppm.

27. The composition of claim 25 wherein said carrier is an aqueous laundry solution; and wherein said silicone gel is present in said solution at a level of from about 5 ppm to about 150 ppm.

28. The composition of claim 26 wherein said aqueous laundry solution is a wash solution.

29. The composition of claim 26 wherein said aqueous laundry solution is a rinse.

30. The liquid fabric care composition of claim 1 wherein said other fabric care compound is a surfactant; and wherein said surfactant is selected from the group consisting of: anionic, nonionic, amphoteric, zwitterionic and cationic surfactants, and mixtures thereof.

31. The liquid fabric care composition of claim 30 wherein said silicone gel is a concentrate which contains from about 0.1% to about 33% by weight of said silicone gel and wherein said concentrate is diluted when used.

32. The liquid fabric care composition of claim 31 wherein said concentrate is an aqueous liquid containing from about 0.5% to about 20% of said silicone gel and said carrier is primarily water.

33. The liquid fabric care composition of claim 30 wherein said concentrate contains from about 1% to about 10% of said silicone gel.

34. A method of improving ease of ironing and the appearance of laundered fabrics comprising: (1) washing said fabrics in a solution containing effective amounts of water, and said composition of claim 30; whereby said silicone gel is deposited onto said fabrics in said wash; (2) rinsing and drying said fabrics; and (3) ironing said fabrics.

35. The fabric care composition of claim 1 wherein said polymeric silicone gel has from about 0.1% to about 8% of said M functional units.

36. The fabric care composition of claim 35 wherein said polymeric silicone gel has from about 80% to about 95% of said D functional units.

* * * * *